US008167020B2

(12) United States Patent
Shanahan et al.

(10) Patent No.: US 8,167,020 B2
(45) Date of Patent: May 1, 2012

(54) UPPER SEAL FOR A HORIZONTAL SIDE-MOVING DOOR

(75) Inventors: Dean Shanahan, Dubuque, IA (US); James C. Boerger, Franksville, WI (US); Ryan P. Beggs, Dubuque, IA (US); Steven Campbell, Peosta, IA (US); William W. Hoerner, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 12/396,061

(22) Filed: Mar. 2, 2009

(65) Prior Publication Data

US 2010/0218429 A1 Sep. 2, 2010

(51) Int. Cl.

| | |
|---|---|
| ***A47H 3/00*** | (2006.01) |
| ***E06B 9/08*** | (2006.01) |
| ***E05B 65/10*** | (2006.01) |
| ***E06B 7/16*** | (2006.01) |
| ***E06B 7/215*** | (2006.01) |
| ***E06B 7/22*** | (2006.01) |

(52) U.S. Cl. ..... 160/266; 160/122; 160/274; 49/141; 49/475.1; 49/480.1; 49/493.1; 49/496.1; 49/500.1

(58) Field of Classification Search ..... 160/122, 160/274, 267.1, 124, 188, 266, 310, 311, 160/330, 40–43; 49/141, 475.1, 480.1, 493.1, 49/496.1, 500.1

See application file for complete search history.

(56) References Cited

U.S. PATENT DOCUMENTS

| | | | |
|---|---|---|---|
| 449,399 | A | 3/1891 | Betham |
| 643,307 | A | 2/1900 | Schmitt |
| 843,011 | A | 2/1907 | Hale et al. |
| 1,220,910 | A | 3/1917 | Toll |
| 1,245,882 | A | 11/1917 | Davis |
| 1,406,951 | A | 2/1922 | Fehr |
| 1,439,373 | A | 12/1922 | Norwood et al. |

(Continued)

FOREIGN PATENT DOCUMENTS

| | | |
|---|---|---|
| AU | 1958292 | 1/1993 |

(Continued)

OTHER PUBLICATIONS

Rite-Hite, "Safe-T-Sprint Power Door," Owner's Manual, Model 8800, Jan. 1, 1997, 44 pages.*

(Continued)

*Primary Examiner* — Blair M Johnson
*Assistant Examiner* — Jaime F Cardenas-Garcia
(74) *Attorney, Agent, or Firm* — Hanley, Flight & Zimmerman, LLC

(57) ABSTRACT

An example of a horizontal side-moving door with a side-winding or horizontally translating curtain includes an upper seal comprising an upper edge of the curtain sliding within a groove of a seal guide. To protect the door in the event of an impact, at least a portion of the curtain's upper edge can restorably pull out from within the groove. To avoid damage in certain situations, the seal guide might resiliently deflect as well. After an impact, the curtain's upper edge is automatically fed back into the groove by simply opening and closing the door. During normal operation, the curtain's upper edge advantageously deflects in response to air pressure against either side of the door. In some examples, the seal guide is of a uniform cross-section, which makes the seal guide easy to manufacture by way of a conventional plastic extrusion process.

24 Claims, 14 Drawing Sheets

U.S. PATENT DOCUMENTS

| | | | | | |
|---|---|---|---|---|---|
| 1,534,210 | A | | 4/1925 | Griffith et al. | |
| 1,681,545 | A | | 8/1928 | Lang | |
| 1,960,860 | A | | 5/1934 | Allen | |
| 2,373,023 | A | | 4/1945 | Goodwin | |
| 2,425,016 | A | | 8/1947 | Weaver | |
| 2,517,713 | A | | 8/1950 | Rissler | |
| 2,811,406 | A | | 10/1957 | Moore et al. | |
| 2,878,532 | A | | 3/1959 | Clark | |
| 3,065,826 | A | | 11/1962 | Tucker, Jr. | |
| 3,074,124 | A | | 1/1963 | Bergstedt | |
| 3,098,519 | A | | 7/1963 | Myers et al. | |
| 3,126,049 | A | * | 3/1964 | Hollands | 160/40 |
| 3,175,254 | A | | 3/1965 | Bromann, Jr. | |
| 3,197,817 | A | | 8/1965 | Voris | |
| 3,385,001 | A | | 5/1968 | Bordner | |
| 3,425,162 | A | | 2/1969 | Halpern | |
| 3,432,966 | A | | 3/1969 | Bordner | |
| 3,460,290 | A | | 8/1969 | Wutzke | |
| 3,529,382 | A | | 9/1970 | Salvarola | |
| 3,535,824 | A | | 10/1970 | Kessler | |
| 3,571,976 | A | | 3/1971 | Schmid | |
| 3,611,637 | A | | 10/1971 | Sanio | |
| 3,653,155 | A | | 4/1972 | de Brunyn, Jr. et al. | |
| 3,732,913 | A | * | 5/1973 | Wrono | 160/133 |
| 3,734,238 | A | | 5/1973 | Secresty et al. | |
| 3,805,450 | A | | 4/1974 | Forcina | |
| 3,807,480 | A | | 4/1974 | Smart | |
| 3,817,161 | A | | 6/1974 | Koplon | |
| 3,883,993 | A | | 5/1975 | Pullan | |
| 3,912,049 | A | | 10/1975 | Holland et al. | |
| 4,058,191 | A | | 11/1977 | Balbo | |
| 4,096,902 | A | | 6/1978 | Junod | |
| 4,115,953 | A | | 9/1978 | Brosenius | |
| 4,180,942 | A | | 1/1980 | Saucier | |
| 4,218,104 | A | | 8/1980 | Anderson et al. | |
| 4,333,511 | A | * | 6/1982 | Johnston | 160/267.1 |
| 4,356,856 | A | | 11/1982 | Bengtsson | |
| 4,357,978 | A | * | 11/1982 | Keller et al. | 160/41 |
| 4,404,770 | A | | 9/1983 | Markus | |
| 4,458,739 | A | * | 7/1984 | Murray et al. | 160/23.1 |
| 4,463,792 | A | * | 8/1984 | Lukos | 160/271 |
| 4,467,853 | A | * | 8/1984 | Downey, Jr. | 160/133 |
| 4,592,270 | A | | 6/1986 | Vener | |
| 4,637,176 | A | | 1/1987 | Acock, Jr. | |
| 4,646,471 | A | | 3/1987 | Shaiu | |
| 4,651,469 | A | | 3/1987 | Ngian et al. | |
| 4,691,478 | A | | 9/1987 | Lorg | |
| 4,735,293 | A | | 4/1988 | Everhart et al. | |
| 4,758,299 | A | | 7/1988 | Burke | |
| 4,961,454 | A | | 10/1990 | Reilly, Jr. et al. | |
| 4,987,638 | A | | 1/1991 | Ribaudo | |
| 5,080,950 | A | | 1/1992 | Burke | |
| 5,083,639 | A | | 1/1992 | Kappeler | |
| 5,165,142 | A | | 11/1992 | Pilsbury | |
| 5,195,594 | A | | 3/1993 | Allen et al. | |
| 5,305,855 | A | | 4/1994 | Rivera et al. | |
| 5,347,755 | A | | 9/1994 | Jaster et al. | |
| 5,381,846 | A | | 1/1995 | Lichy | |
| 5,383,510 | A | | 1/1995 | Allen | |
| 5,427,205 | A | | 6/1995 | Saillio et al. | |
| 5,899,303 | A | | 5/1999 | Allen | |
| 6,003,583 | A | | 12/1999 | Lacoste et al. | |
| 6,082,432 | A | * | 7/2000 | Kissinger | 160/290.1 |
| 6,123,135 | A | * | 9/2000 | Mathews | 160/26 |
| 6,330,763 | B1 | | 12/2001 | Kern et al. | |
| 6,352,097 | B1 | | 3/2002 | Kern et al. | |
| 6,629,555 | B2 | * | 10/2003 | DeBlock et al. | 160/31 |
| 7,025,105 | B2 | * | 4/2006 | Lancina | 160/41 |
| 7,264,088 | B2 | | 9/2007 | Spiess et al. | |
| 2002/0056236 | A1 | | 5/2002 | Kalempa et al. | |
| 2006/0137836 | A1 | | 6/2006 | Harbison | |

FOREIGN PATENT DOCUMENTS

| | | |
|---|---|---|
| CH | 0196048 | 5/1938 |
| DE | 0573632 | 3/1933 |
| DE | 29808179 | 9/1998 |
| EP | 0478938 | 4/1992 |
| FR | 0980892 | 5/1951 |
| FR | 1514166 | 1/1968 |
| FR | 2582343 | 11/1969 |
| FR | 2191010 | 2/1974 |
| FR | 2305598 | 10/1976 |
| FR | 2315598 | 2/1977 |
| GB | 2219618 | 12/1989 |
| JP | 05118180 | 5/1993 |
| JP | 06032572 | 2/1994 |
| JP | 06072681 | 3/1994 |
| JP | 2003239634 | 8/2003 |
| JP | 2006009291 | 1/2006 |
| JP | 2006009292 | 1/2006 |
| WO | 0118469 | 3/2001 |
| WO | 2005056965 | 6/2005 |

OTHER PUBLICATIONS

International Searching Authority, "International Search Report," issued in connection with international application serial No. PCT/US2010/025788, mailed Jul. 4, 2011, 5 pages.

International Searching Authority, "Written Opinion of the International Searching Authority," issued in connection with international application serial No. PCT/US2010/025788, mailed Jul. 4, 2011, 8 pages.

International Bureau, "International Preliminary Report on Patentability," issued in connection with international application serial No. PCT/US2010/025788, mailed Sep. 15, 2011, 8 pages.

Mexican Patent Office, "Office Action," issued in connection with Mexican application serial No. PA/a/2002/002621, issued on Jun. 15, 2005, 4 pages.

International Searching Authority, "International Search Report," issued in connection with international application serial No. PCT/US00/25030, mailed Jul. 12, 2001, 7 pages.

International Searching Authority, "International Preliminary Examination Report," issued in connection with international application serial No. PCT/US00/25030, mailed Jul. 12, 2001, 3 pages.

United States Patent and Trademark Office, "Notice of Allowance and Fees Due," issued in connection with U.S. Appl. No. 09/394,796, mailed Jul. 26, 2001, 5 pages.

United States Patent and Trademark Office, "Final Office Action," issued in connection with U.S. Appl. No. 09/394,796, mailed Dec. 15, 2000, 8 pages.

International Searching Authority, "Written Opinion," issued in connection with international application serial No. PCT/US00/25030, mailed Jul. 16, 2001, 6 pages.

United States Patent and Trademark Office, "Non-Final Office Action," issued in connection with U.S. Appl. No. 09/394,796, mailed on Mar. 29, 2000, 5 pages.

United States Patent and Trademark Office, "Non-Final Office Action," issued in connection with U.S. Appl. No. 09/394,796, mailed on Dec. 8, 1999, 4 pages.

Jamison Door Company "Full Product Line" Jamison Sound Reduction, Special Purpose, Cold Storage Doors brochure, Jamison Door Company, 1988, 8 pages.

Manifatture Tecnolegno Hartz "Thermo Insulating Door Systems," Preisliste (1996), 33 pages.

Therm-L-Tec Systems, Inc. "Introducing the SST Smooth Operator System Brochure" 1990, 6 pages.

European Patent Office, "Office Action," issued in connection with European application serial No. 00960095.8-2301, issued on May 8, 2004, 3 pages.

Canadian Intellectual Property Office, "Office Action" issued in connection with Canadian application No. 2,384,533, mailed on Mar. 4, 2005, 4 pages.

Canadian Intellectual Property Office, "Notice of Allowance" issued in connection with Canadian application No. 2,384,533, mailed on Nov. 17, 2005, 1 page.

* cited by examiner

UPPER SEAL FOR A HORIZONTAL SIDE-MOVING DOOR

FIELD OF THE DISCLOSURE

This patent generally pertains to a horizontal side-moving door and, more specifically, to an upper seal for such a door.

BACKGROUND

Typical horizontal side-moving doors include either a rigid or semi-rigid planar door panel that translates horizontally in front of a doorway or a flexible door panel that coils about a roller as a leading edge of the flexible panel translates horizontally in front of the doorway. Horizontal side-moving doors with a flexible panel and a roller can be referred to as horizontal side-rolling doors.

Horizontal side-rolling doors, such as the one disclosed in U.S. Pat. No. 4,096,902, include one or two vertical rollers at either one or both lateral edges of the doorway. Some horizontal side-rolling doors have a single roller at one side of the doorway with a single curtain that extends and retracts across the full width of the doorway.

In some cases, the "single curtain" is actually comprised of two layers, each having its own vertical take-up roller. In such cases, the two rollers are right next to each other at one lateral edge of the doorway. As the door opens, the two layers of the curtain separate at the edge of the doorway and wrap upon their respective rollers.

Other horizontal side-rolling doors include two individual curtains, each supported by its own roller at opposite lateral edges of the doorway. For such doors, the leading edges of the two separate curtains meet at the center of the doorway as the door closes. To open the door, the two curtains move apart from each other and wrap upon their own roller (or set of rollers if each curtain has two layers).

The leading edges of side-rolling curtains and planar door panels are often reinforced by a relatively rigid, vertically elongate member that can be susceptible to being accidentally struck by a forklift passing through the doorway. To prevent permanent damage to the door in the event of a collision, the door panel or curtain is often made to restorably break away.

DETAILED DESCRIPTION

Figure 1:
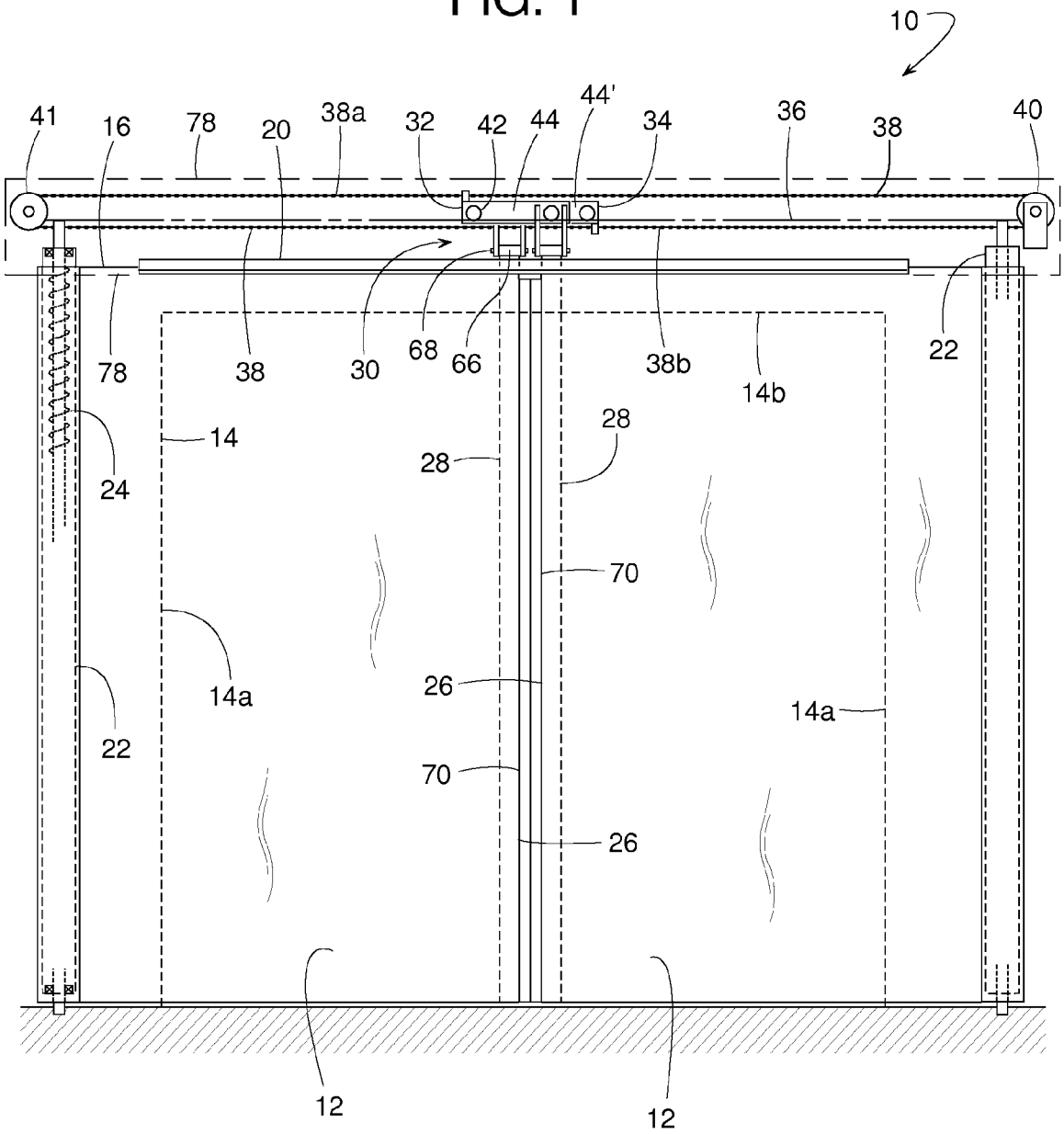
FIG. 1 is a front view of one example of a horizontal side-moving door shown in a closed position.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any examples may be included with, a replacement for, or otherwise combined with other features from other examples.

The leading edges of some side-rolling curtains and planar door panels are often reinforced by a relatively rigid, vertically elongate member that can be susceptible to being accidentally struck by a forklift passing through the doorway. The need for the vertically elongate member, either with or without such a breakaway feature, however, can make it difficult to design an effective seal at the upper edge of the door.

FIGS. 1-12 show a horizontal side-moving door or door 10 with at least one flexible curtain 12 that moves horizontally across a doorway 14 in a wall 15 to open and close the door 10. To seal an upper edge 16 of curtain 12, upper edge 16 slides within a seal groove 18 (FIG. 4) of a seal member 20. In some examples, upper edge 16 and curtain 12 may be a unitary piece. In this particular example, door 10 includes two similar curtains 12 supported by spring-loaded rollers 22 installed in proximity with lateral edges 14*a* of doorway 14. A preloaded torsion spring 24 urges each of the spring-loaded rollers 22 to rotate in a direction that tends to draw in and wrap its respective curtain 12 onto itself.

Figure 2:
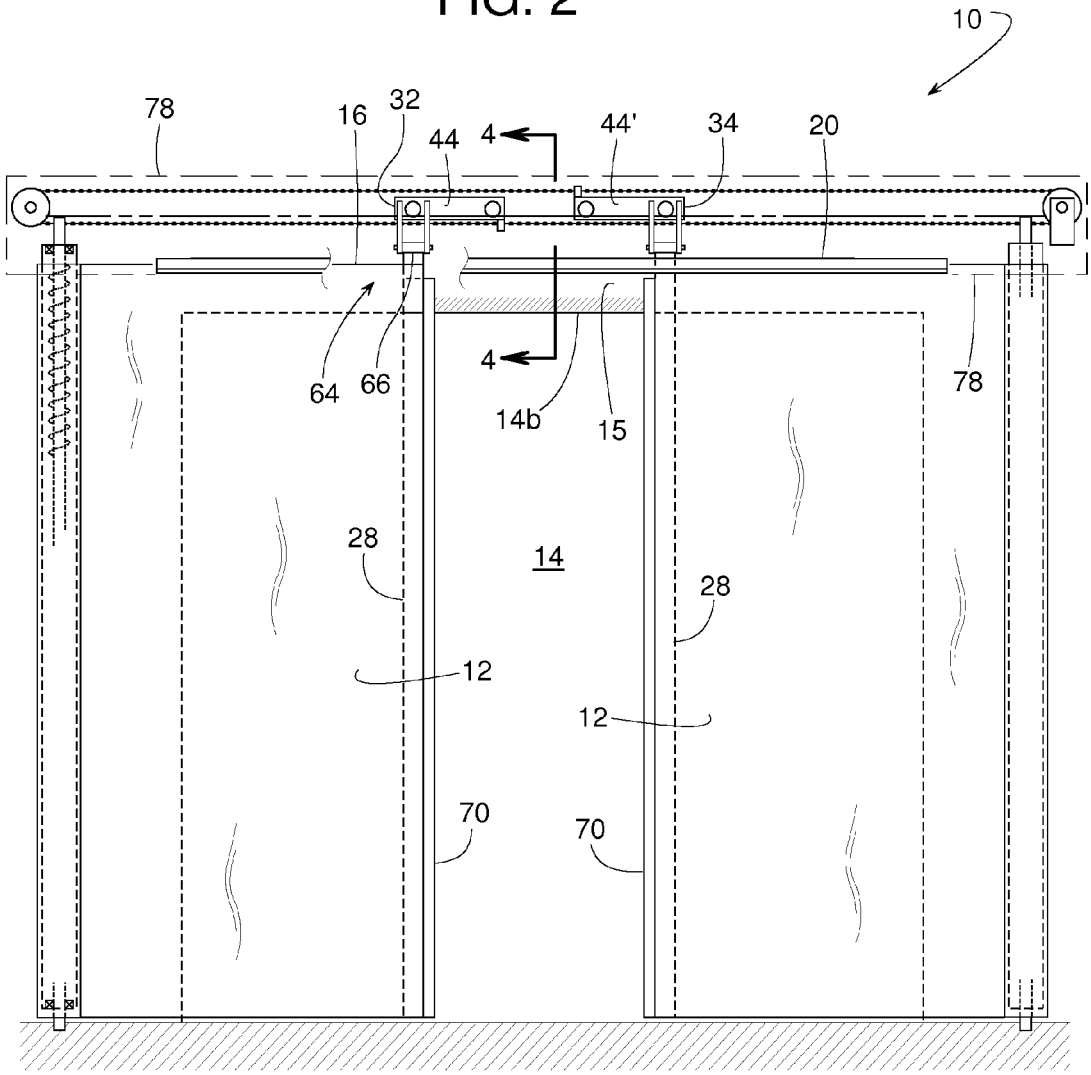
FIG. 2 is a front view of the door of FIG. 1 but showing the door partially open.
Figure 3:
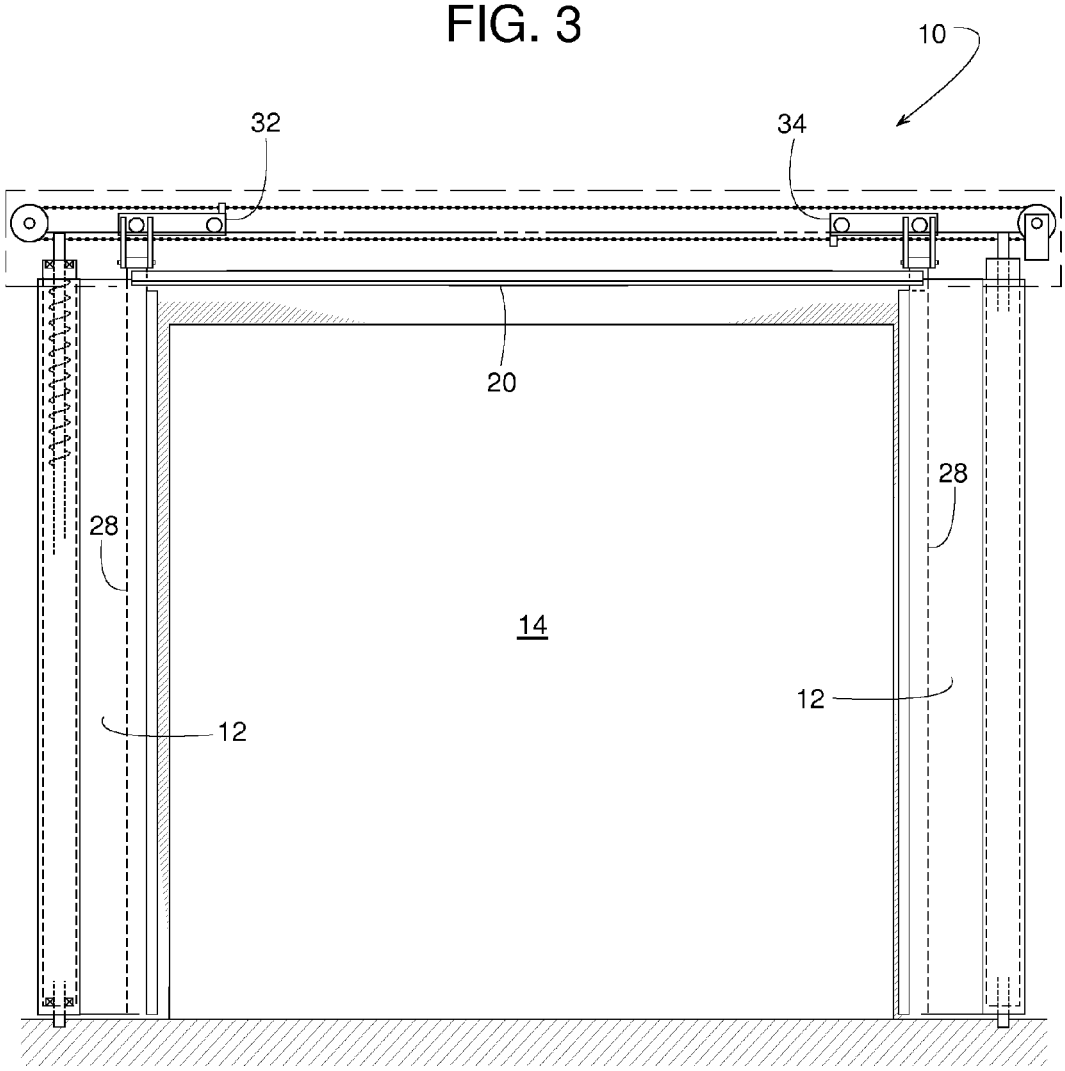
FIG. 3 is a front view of the door of FIG. 1 but showing the door fully open.

In order to open and close door 10, a leading edge 26 of curtains 12 are attached to relatively rigid elongate members 28 that are coupled to a drive unit 30. Elongate members 28 can be made of rectangular steel tubing or of some other suitable material and shape that renders elongate members 28 stiffer than curtains 12. For the illustrated example, drive unit 30 comprises two track followers 32 and 34 that are mounted for horizontal translation along an overhead track 36 that is installed in proximity with an upper edge 14*b* of doorway 14. Elongate member 28 extends downward from track follower 32, and the other elongate member 28 extends downward from track follower 34. A chain 38 and/or cogged belt powered by a motor-driven wheel 40 and an idler wheel 41 is coupled to track followers 32 and 34. Track follower 32 connects to an upper section 38*a* of chain 38, and track follower 34 connects to a lower section 38*b* of chain 38 so that depending on the rotational direction of motor-driven wheel 40, drive unit 30 either moves elongate members 28 apart or together to respectively open or close the door 10. FIG. 1 shows door 10 in a closed position with the curtains' 12 leading edges 26 abutting each other near the center of doorway 14, FIG. 3 shows door 10 in an open position with most of the curtain 12 wrapped around spring-loaded rollers 22, and FIG. 2 shows door 10 partially open.

It should be noted that the actual structure of track 36 and track followers 32 and 34 could vary widely and still be within the scope of this disclosure. For the illustrated example, track follower 32 includes several rollers 42 for weight support and for limiting the tipping of track follower 32. An extension arm 44 can enhance the track follower's 32 ability to resist tipping. Additional rollers 46 can further resist tipping and help guide the track follower 32 along the length of track 36. In some cases, extension arm 44 on track follower 32 and a similar extension arm 44' on track follower 34 can pass by each other in an overlapping relationship, as shown in FIG. 1. Although chain 38 is shown coupled to extension arms 44 and 44', this was illustrated in this manner to clearly show the functional relationship between chain 38 and track followers 32 and 34. Chain 38 can be connected to other points on track followers 32 and 34.

Figure 4:
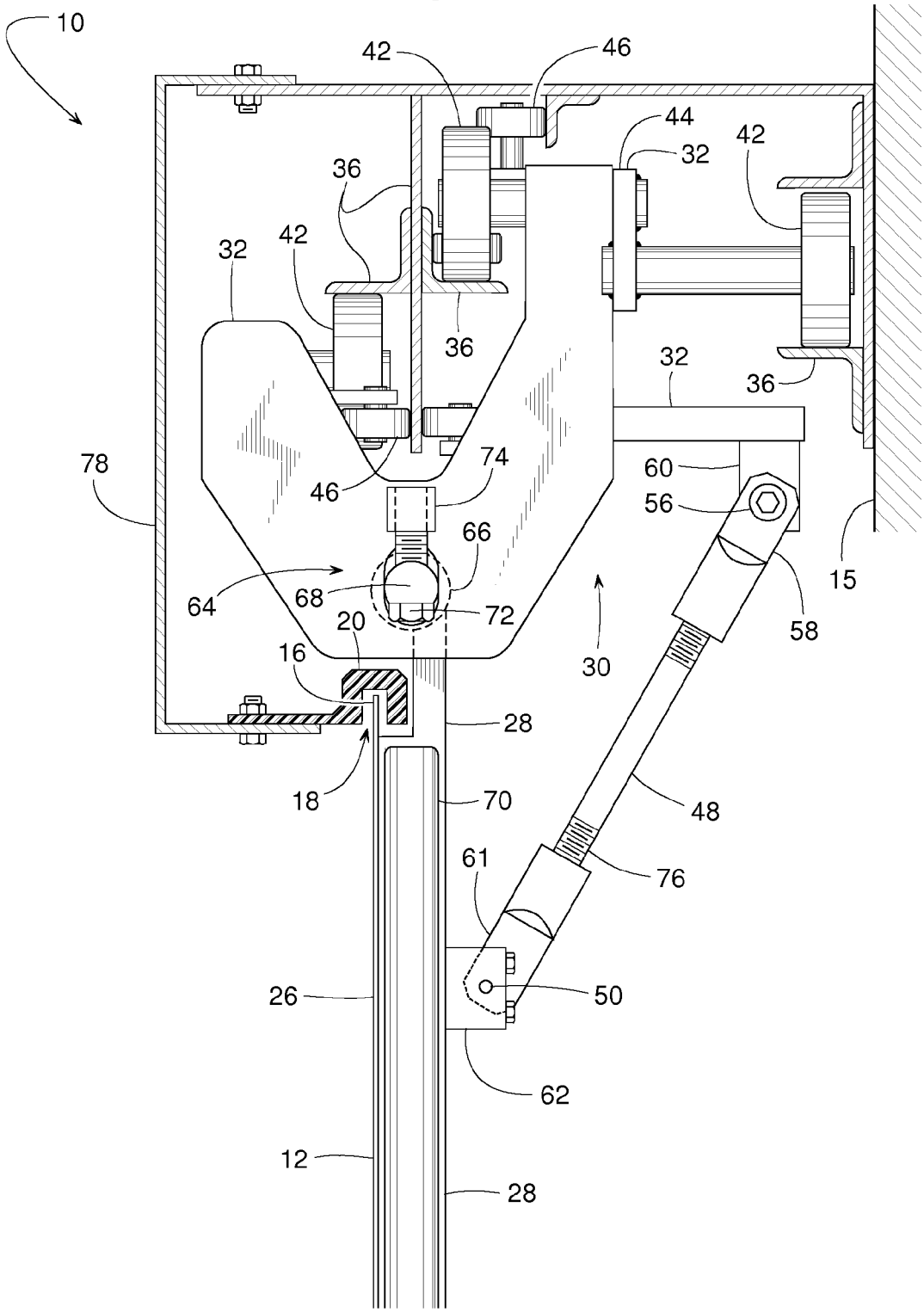
FIG. 4 is a cross-sectional view taken along line 4-4 of FIG. 2.
Figure 5:
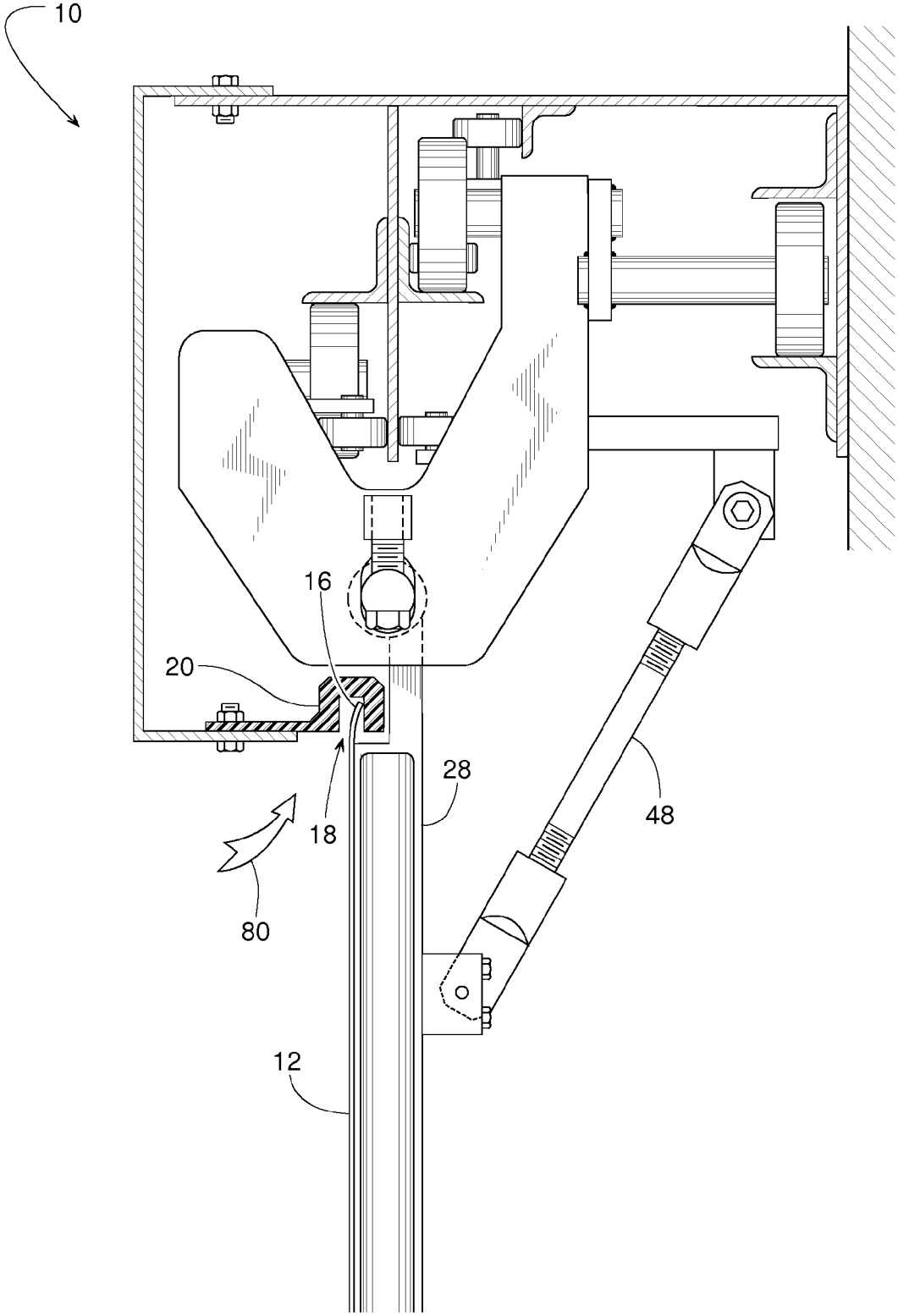
FIG. 5 is a cross-sectional view similar to FIG. 4 but showing air pressure deflecting the curtain's upper edge.
Figure 6:
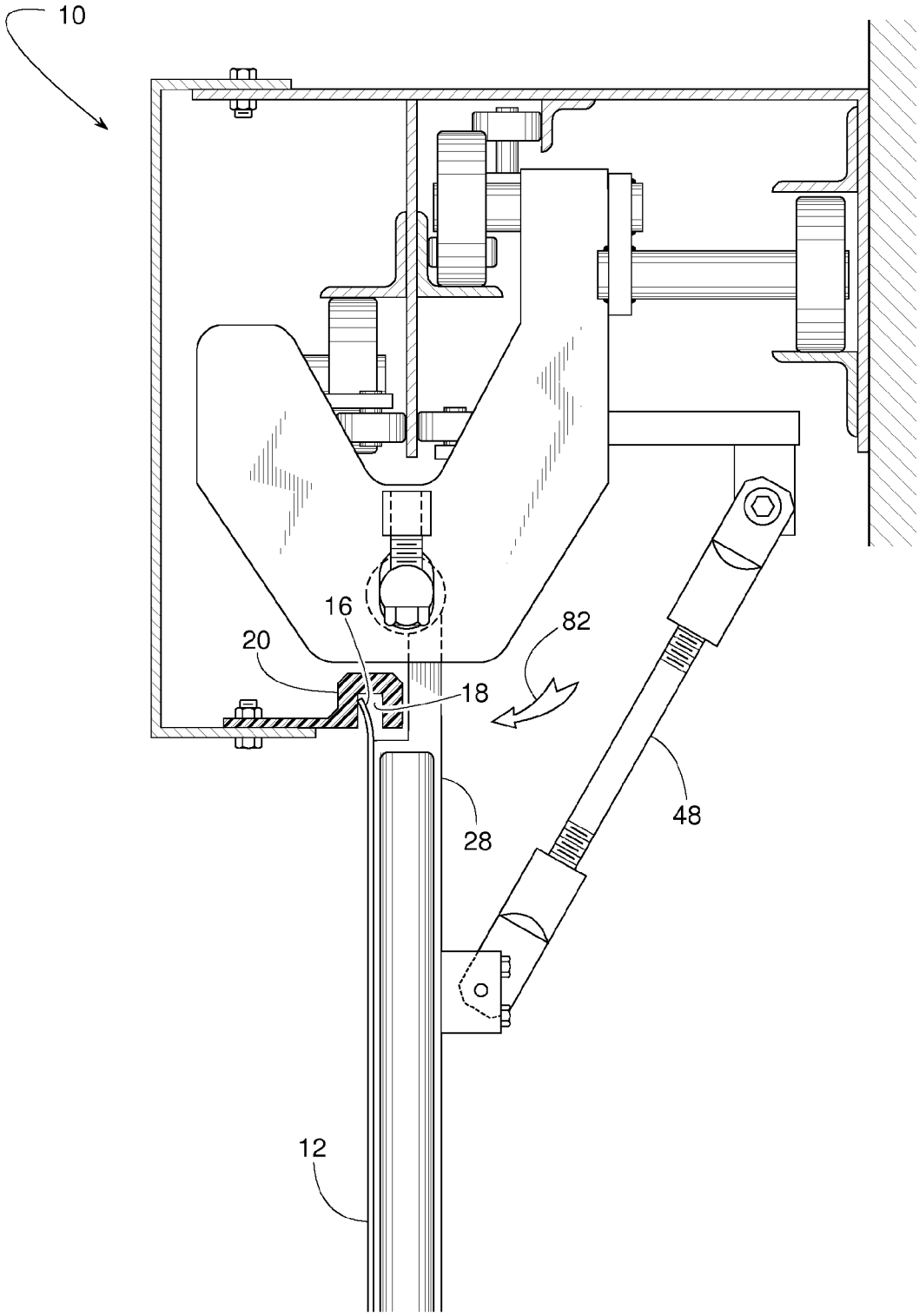
FIG. 6 is a cross-sectional view similar to FIG. 5 but showing air pressure deflecting the curtain's upper edge in an opposite direction.
Figure 7:
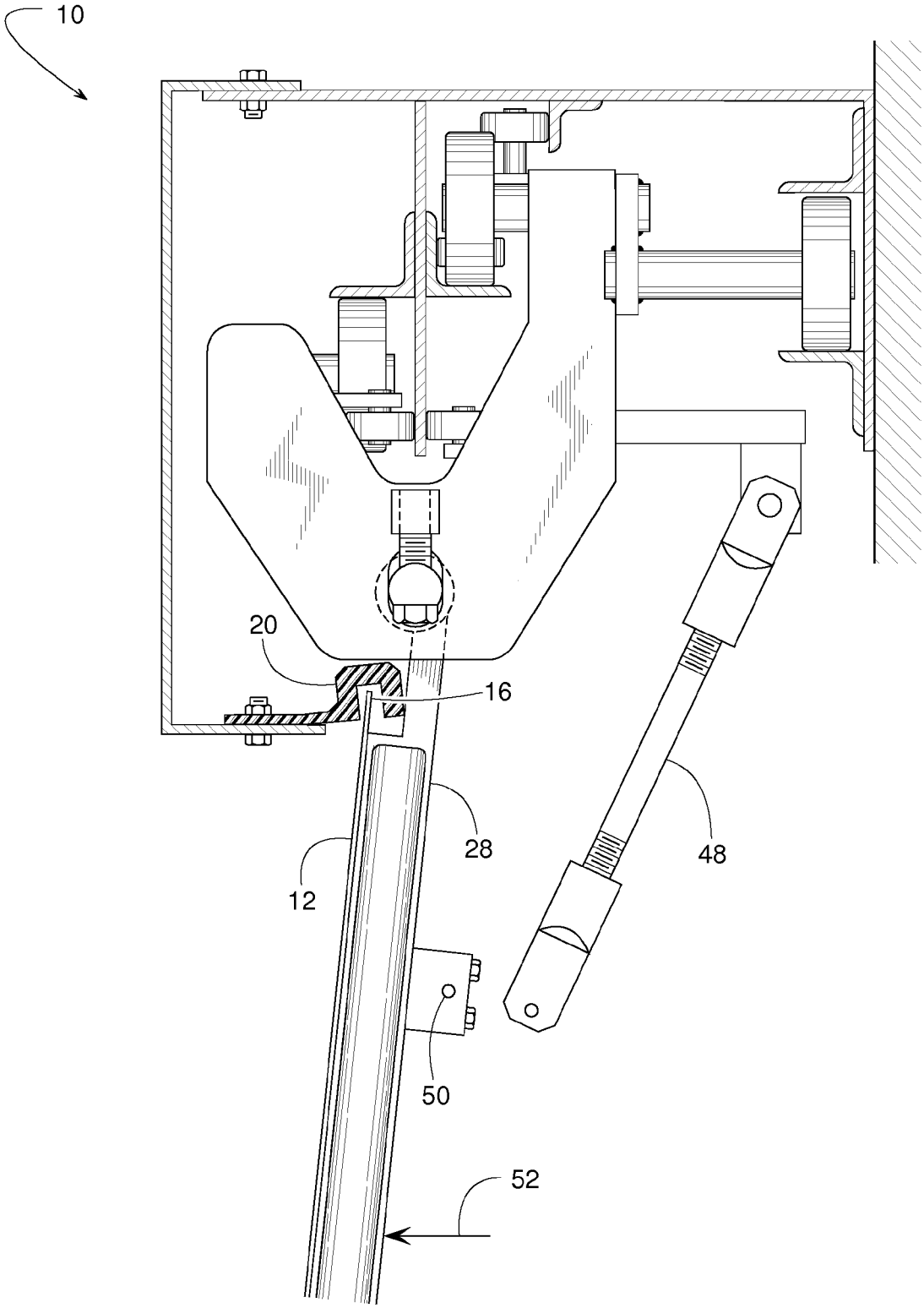
FIG. 7 is a cross-sectional view similar to FIG. 4 but showing the seal guide deflecting upward in reaction to a vertically elongate member being forced in one direction.
Figure 8:
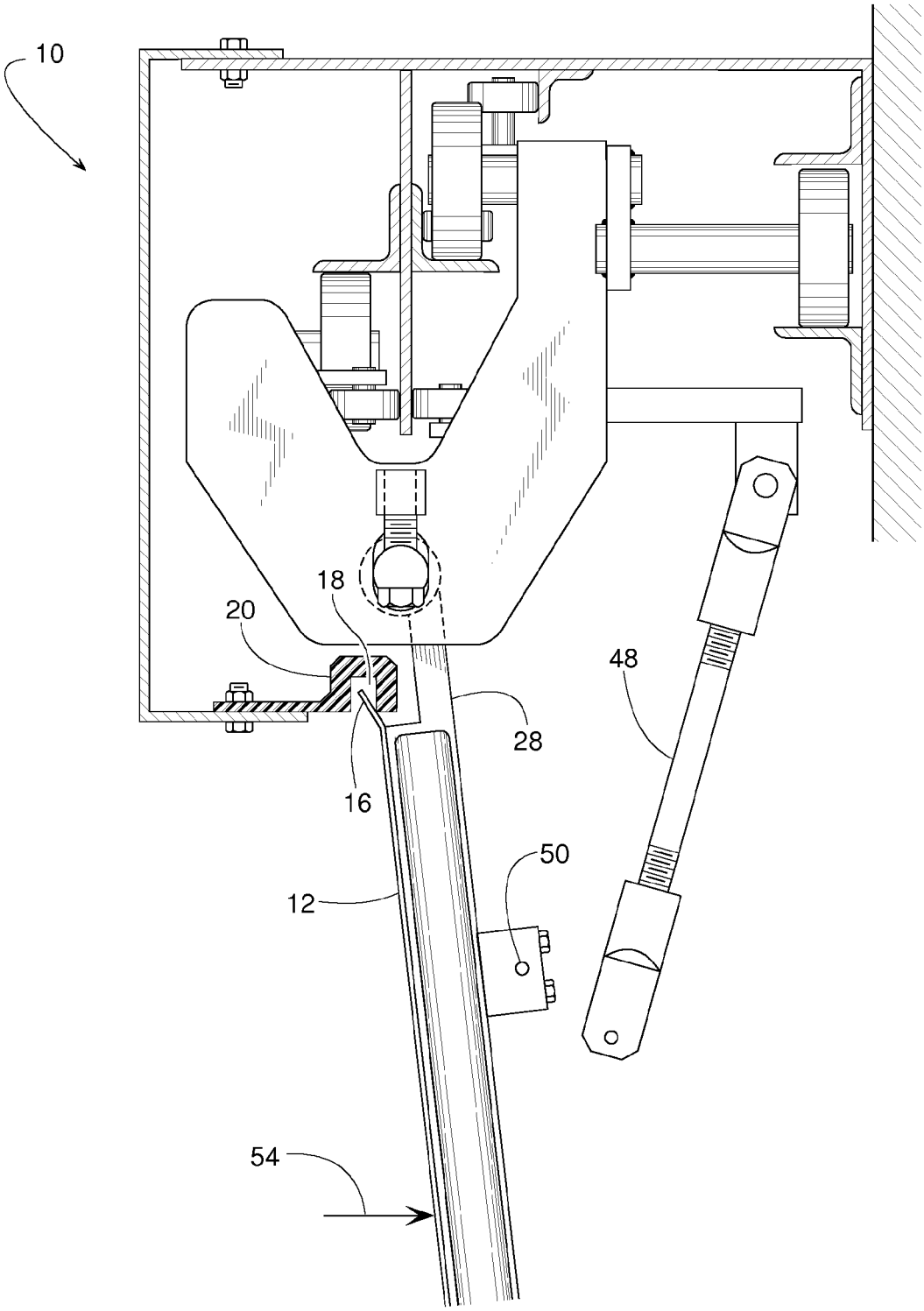
FIG. 8 is a cross-sectional view similar to FIG. 7 but showing the curtain's upper edge deflecting in reaction to the vertically elongate member being forced in an opposite direction.

To hold elongate members 28 substantially vertical to facilitate operation and proper-closed alignment of elongate members 28 yet still make the door 10 able to remain operational and/or functional in the event of an accidental impact with a forklift or some other collision, elongate members 28 are each supported by a brace 48 (FIG. 4) that includes a yieldable member 50 (e.g., a shear pin), as shown in FIG. 4. FIGS. 4-6 show brace 48 in its usual configuration with elongate member 28 and door 10 being in a normally operative position. FIG. 7 shows a force 52 of impact forcing elongate member 28 to one dislodged position, and FIG. 8 shows another impact force 54 in an opposite direction forcing elongate member 28 to another dislodged position.

In the operative position of FIGS. 4-6, a conventional fastener 56 pivotally connects an upper end 58 of brace 48 to a lug 60 on track follower 32, and yieldable member 50 connects a lower end 61 of brace 48 to a lug 62 extending from elongate member 28. In this case, yieldable member 50 is in the form of a steel shear pin extending through lower end 61 and lug 62; however, yieldable member 50 could be of various other designs and could be installed as any breakable or otherwise yieldable link between track follower 32 and elongate member 28. The location of yieldable member 50 and fastener 56, for instance, could be interchanged.

If force 52 or 54 is excessive, yieldable member 50 shears or breaks to protectively release elongate member 28 from brace 48. After a breakaway incident, yieldable member 50 can be replaced by an unbroken one. Until such a repair can be done, a pivotal coupling 64 between elongate member 28 and track follower 32 enables elongate member 28 to hang generally vertical so that door 10 can still be open and closed while brace 48 is disconnected.

Pivotal coupling 64 can be a sleeve 66 journalled to a generally horizontal shaft 68, wherein shaft 68 is attached to track follower 32, and sleeve 66 is attached to the upper end 58 of elongate member 28. Such a coupling permits pivotal motion in the same general direction that forklifts pass through doorway 14, thus, elongate member 28 can "break away" or swing in a direction that elongate member 28 is mostly likely to be struck, i.e., in a direction generally perpendicular to the plane of doorway 14.

To enable leading edge seals 70 of curtains 12 come together in sealingly tight engagement when door 10 closes, elongate members 28 preferably hang generally parallel and vertical as viewed in FIG. 1. To accomplish this, an adjustment screw 72 (FIG. 4) between one end of shaft 68 and a lug 74 extending from track follower 32 can be tightened or loosened to level shaft 68. To enable leading edge seals 70 to be substantially coplanar, the length of brace 48 can be made adjustable. In a currently preferred example, a threaded shank 76 of brace 48 can be screwed farther in or out of ends 58 and/or 61 to adjust the brace's 48 overall length, which in turn adjusts the angle between elongate members 28 and the plane of doorway 14.

As for sealing the upper edge of door 10, a preferred example includes a seal guide or seal member 20 in the form of a plastic extrusion mounted to a front cover 78 and extending the width of doorway 14. A seal is created between curtain 12 and seal member 20 by virtue of upper edge 16, which can be an integral extension of curtain 12 and/or an added strip of material extending into and moving along seal groove 18. The penetration of upper edge 16 into seal groove 18 enables both faces of upper edge 16 to have sealing contact with seal groove 18.

Upper edge 16 may be sufficiently flexible to deflect in a way that maintains an effective seal whether there is a positive or negative pressure differential across door 10. In FIG. 5, for instance, air pressure 80 from one side of door 10 deflects flexible upper edge 16 in one direction against seal member 20, and FIG. 6 shows air pressure 82 from the other side of door 10 deflecting upper edge 16 in an opposite direction against seal member 20.

Even if upper edge 16 is not sufficiently flexible to react in this way to such pressure differentials, the structure of seal member 20 enhances the sealing function. Because seal member 20 defines seal groove 18 into which upper edge 16 extends, a tortuous air path is created for air moving from one side of the door 10 to the other, because the air turns several corners going up, over, and back down relative to upper edge 16. This tortuous path itself creates a pressure differential across upper edge 16, which impedes the free flow of air, thus, enhancing sealing.

Since seal member 20 extends over upper edge 16 with both sides of upper edge 16 being enveloped within seal groove 18, seal member 20 and the upper edge 16 of elongate member 28 are in laterally spaced relation to avoid interference between seal member 20 and elongate member 28 as elongate member 28 translates along its path of travel. This is particularly true because elongate member 28 is hanging generally pendant from an elevated support point (shaft 68), and seal member 20 is below that support point yet is above upper edge 16.

Upper edge 16 and/or seal member 20 are also responsive to a breakaway condition, as shown in FIGS. 7 and 8. FIG. 7 shows seal member 20 having sufficient flexibility to bend upward in reaction to elongate member 28 being forced against seal member 20, and FIG. 8 shows upper edge 16 having sufficient flexibility to deflect in response to excessive movement in elongate member 28.

Figure 9:
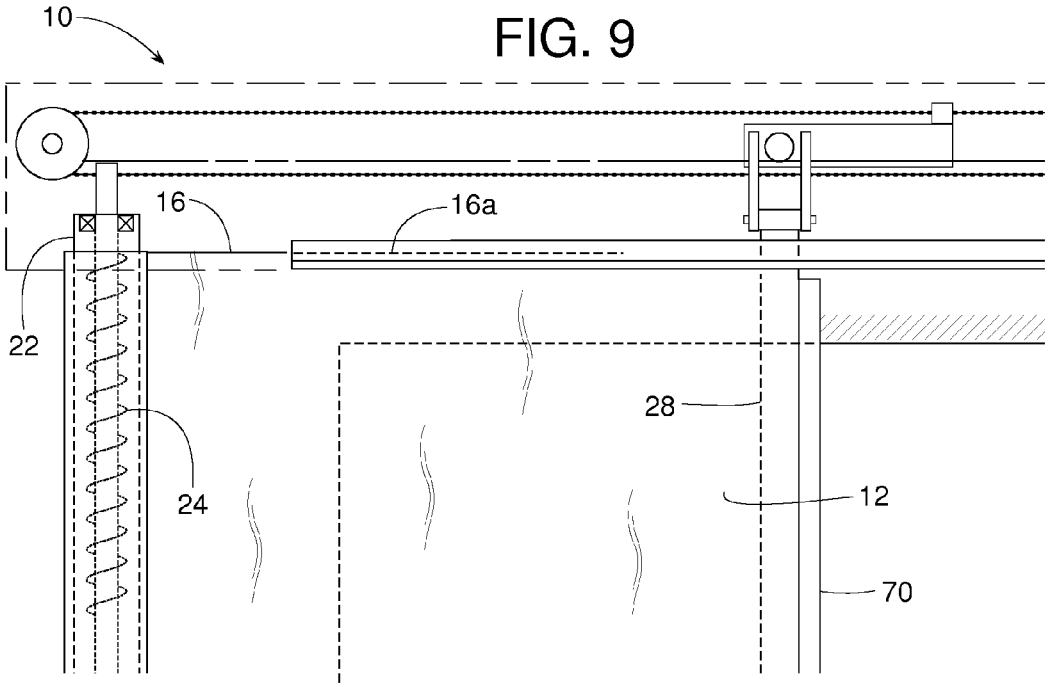
FIG. 9 is a partial front view similar to FIG. 2, wherein the door is about to be struck.

Under certain breakaway conditions, a breakaway portion **16*a* (FIGS. 10 and 11) of the curtain's upper edge 16 may get pulled out from within seal groove 18 of seal member 20 and, thus, in some examples, the breakaway portion 16*a* is free to escape from within the seal groove 18. Such a condition causing a breakaway and an operational sequence to restore door 10 to it normal operation is illustrated in FIGS. 9-12. FIG. 9 shows door 10 partially open and prior to being struck, thus, breakaway portion 16*a* is still properly engaged within seal groove 18**.

Figure 10:
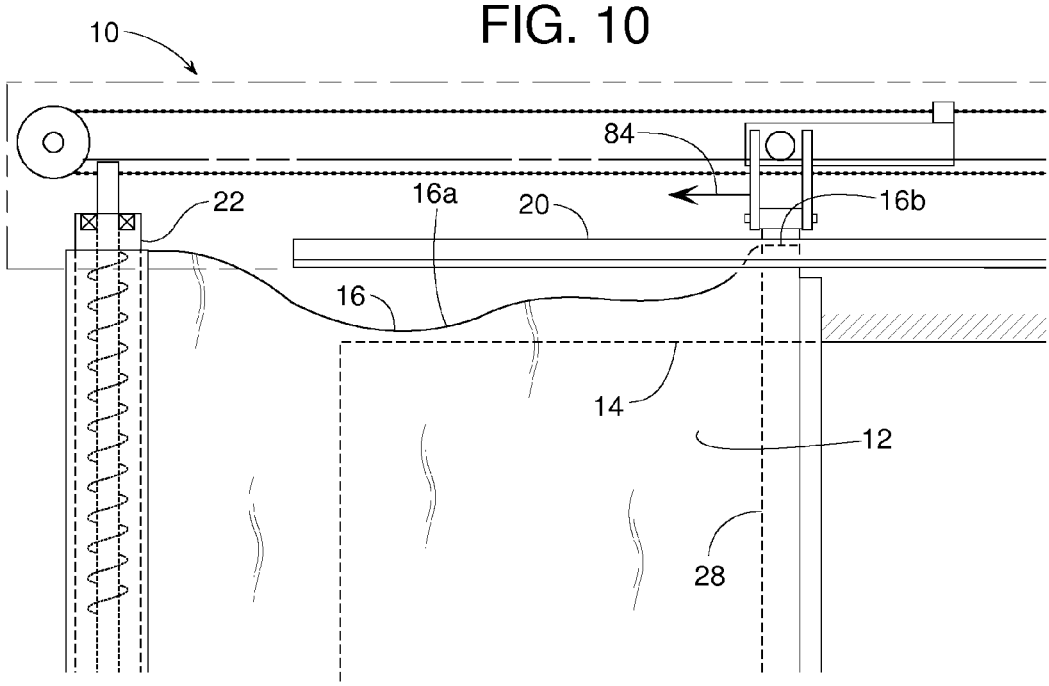
FIG. 10 is a partial front view similar to FIG. 9 but showing a portion of the curtain's upper edge being dislodged by an impact.

FIG. 10 shows door 10 having been struck with sufficient force to pull breakaway portion **16*a* of the curtain's upper edge 16 out from within seal groove 18. It should be noted, however, that a leading end 16*b* of upper edge 16 still remains within seal groove 18. This is because leading end 16***b* is immediately adjacent to elongate member 28 and is thus supported by elongate member 28, whereas breakaway portion 16*a* of upper edge 16 is relatively free and unsupported. To reinsert breakaway portion 16*a* in seal groove 18, door 10 first is moved to its open position as indicated by arrow 84 of FIG. 10.

Figure 11:
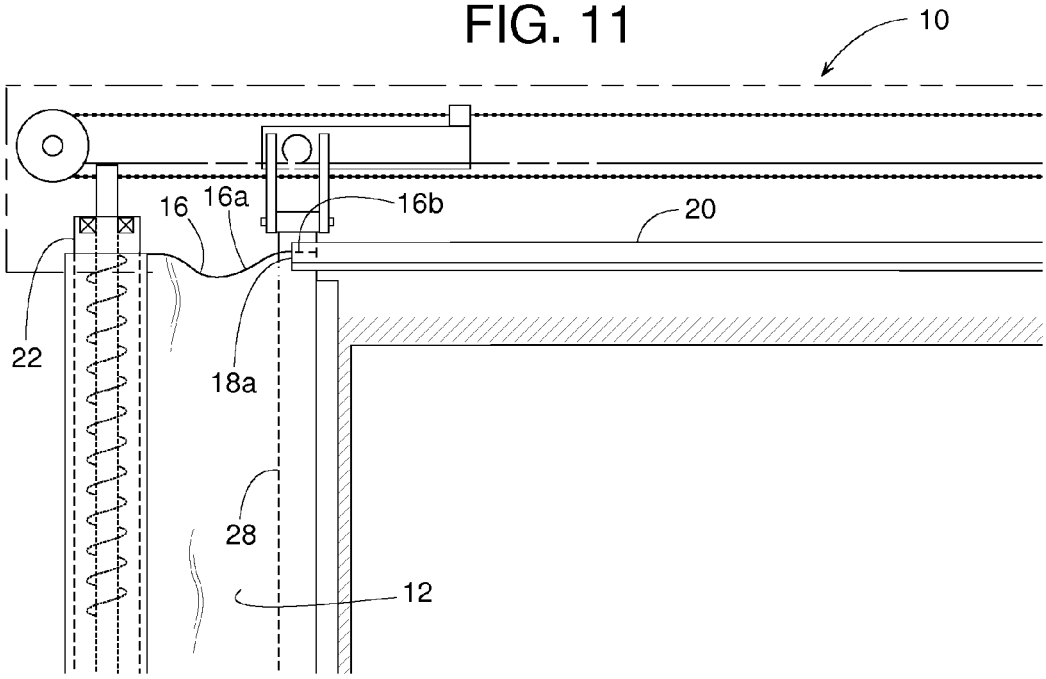
FIG. 11 is a partial front view similar to FIG. 10 but showing the door in its fully open position.

Once door 10 is in its fully open position, as shown in FIG. 11, breakaway portion 16*a* of upper edge 16 is positioned at the seal guide's 20 entrance or a lead-in opening 18*a* that guides breakaway portion 16*a* of upper edge 16 back into seal groove 18. Lead-in opening 18*a* can simply be where seal groove 18 is open at the distal ends of seal member 20, thus, lead-in opening 18*a* has a profile equal to or greater than that of seal groove 18 as shown in FIGS. 4-8. Lead-in opening 18*a* may include edges with smoothly tapered guide-in surfaces or the edges could be squared corners.

Figure 12:
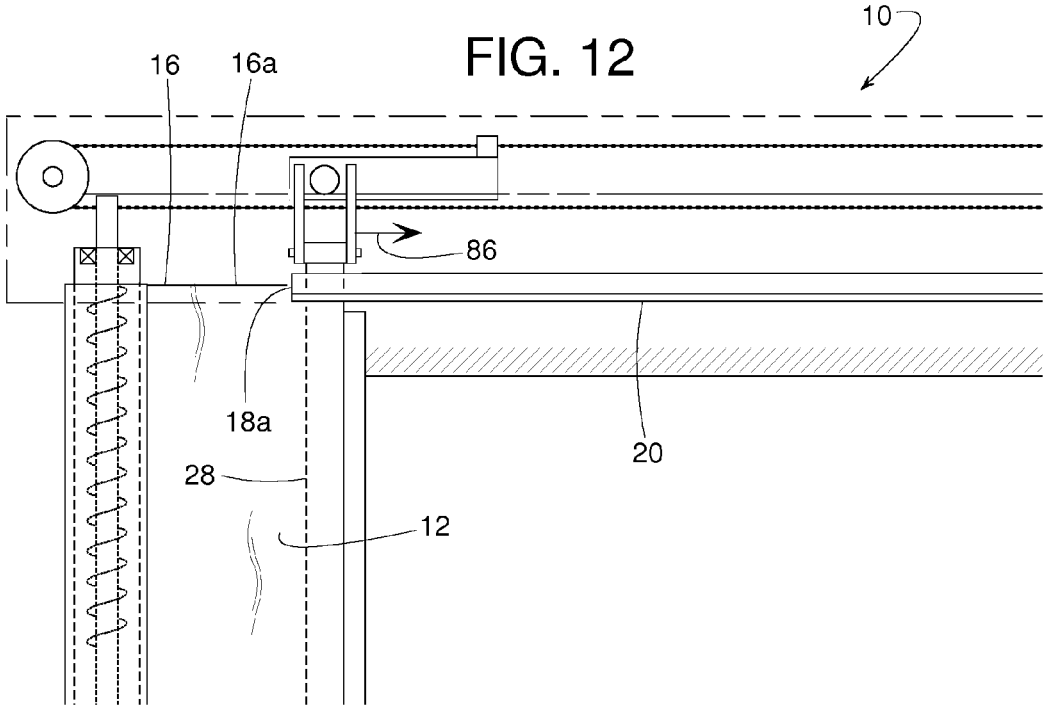
FIG. 12 is a partial front view similar to FIG. 11 but showing the door closing as a means to restore the upper seal to its normal operating condition.

After door 10 is in the open position of FIG. 11, door 10 can be closed by track follower 32 moving elongate member 28 and curtain 12 in the direction indicated by arrow 86 of FIG. 12. Such movement automatically draws the curtain's breakaway portion 16*a*, including breakaway portion 16*a*, back into seal groove 18. Although FIGS. 10 and 11 show significant slack in the curtain's upper edge 16, such slack can actually be taken up by spring-loaded roller 22 exerting tension on curtain 12.

Figure 13:
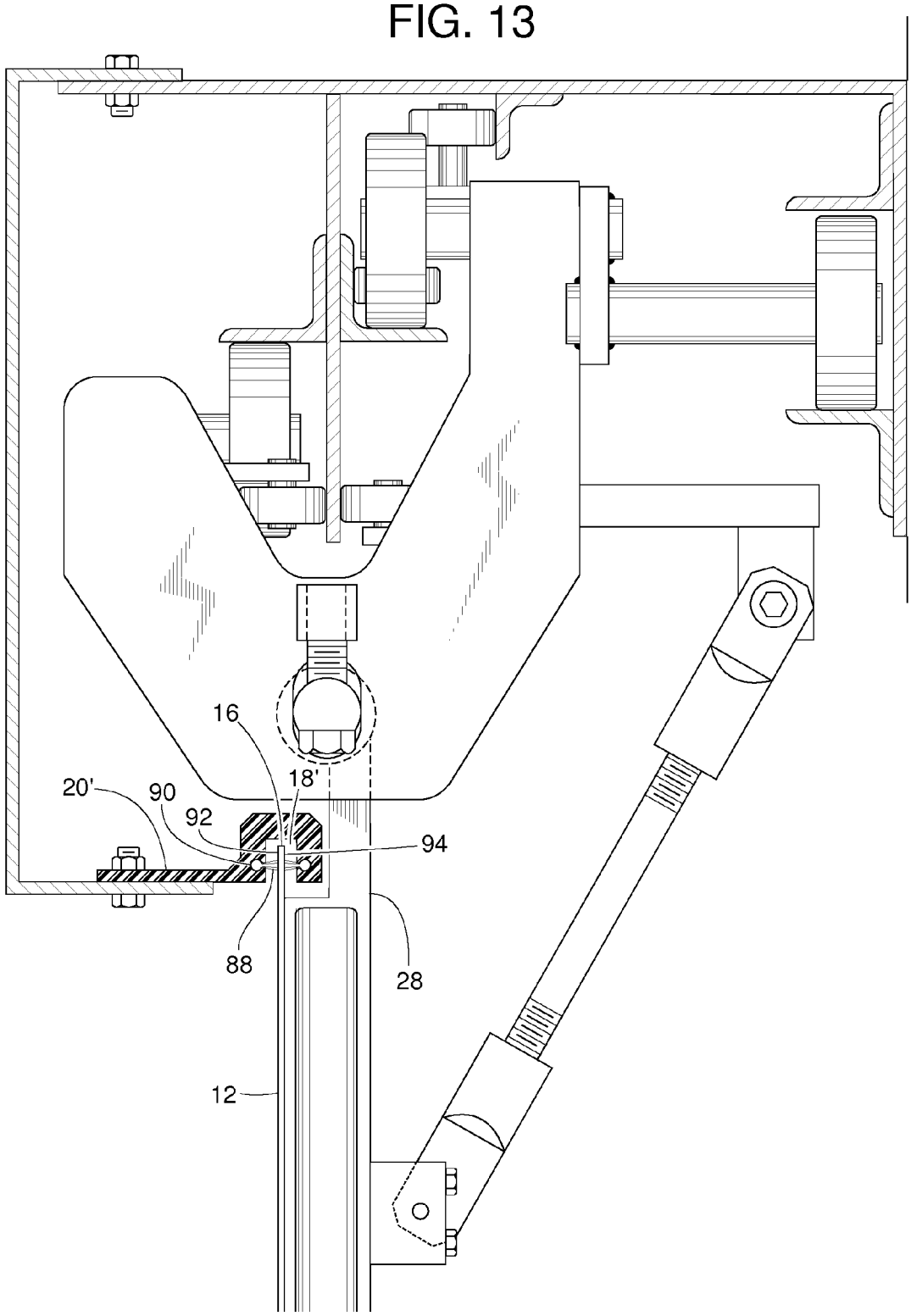
FIG. 13 is a cross-section view similar to FIG. 4 but showing another example of a seal guide.

Referring to FIG. 13, sealing between a seal guide 20' and the curtain's upper edge 16 can be enhanced by installing separate contacting seal members (e.g., a brush seal 88, flexible lip, resilient foam strip, bulb seal, etc.) that contact one or both sides (faces 92 and 94) of upper edge 16. For sake of example, FIG. 13 shows the contacting seal members as being brush seals 88 installed within a groove 18' of seal guide 20'. Brush seals 88 preferably extend the full length of seal guide 20'. In this particular example, each brush seal 88 is inserted into a brush groove 90 in seal guide 20'; however, brush seal 88 or an equivalent thereof (e.g., flexible lip, resilient foam strip, bulb seal, etc) could be attached to a seal member by various other conceivable means.

Figure 14:
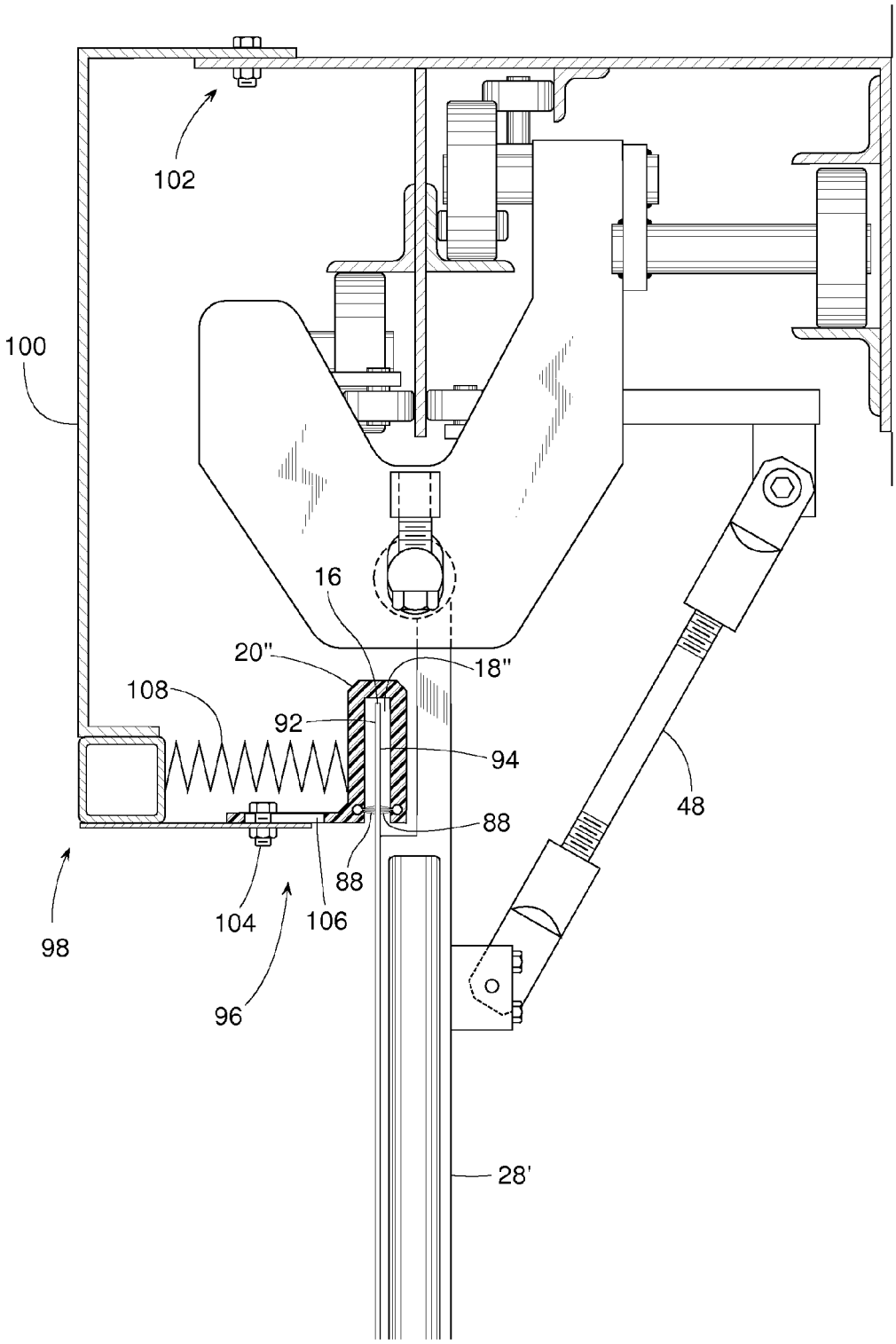
FIG. 14 is a cross-sectional view similar to FIGS. 4 and 13 but showing another example of a seal guide.
Figure 15:
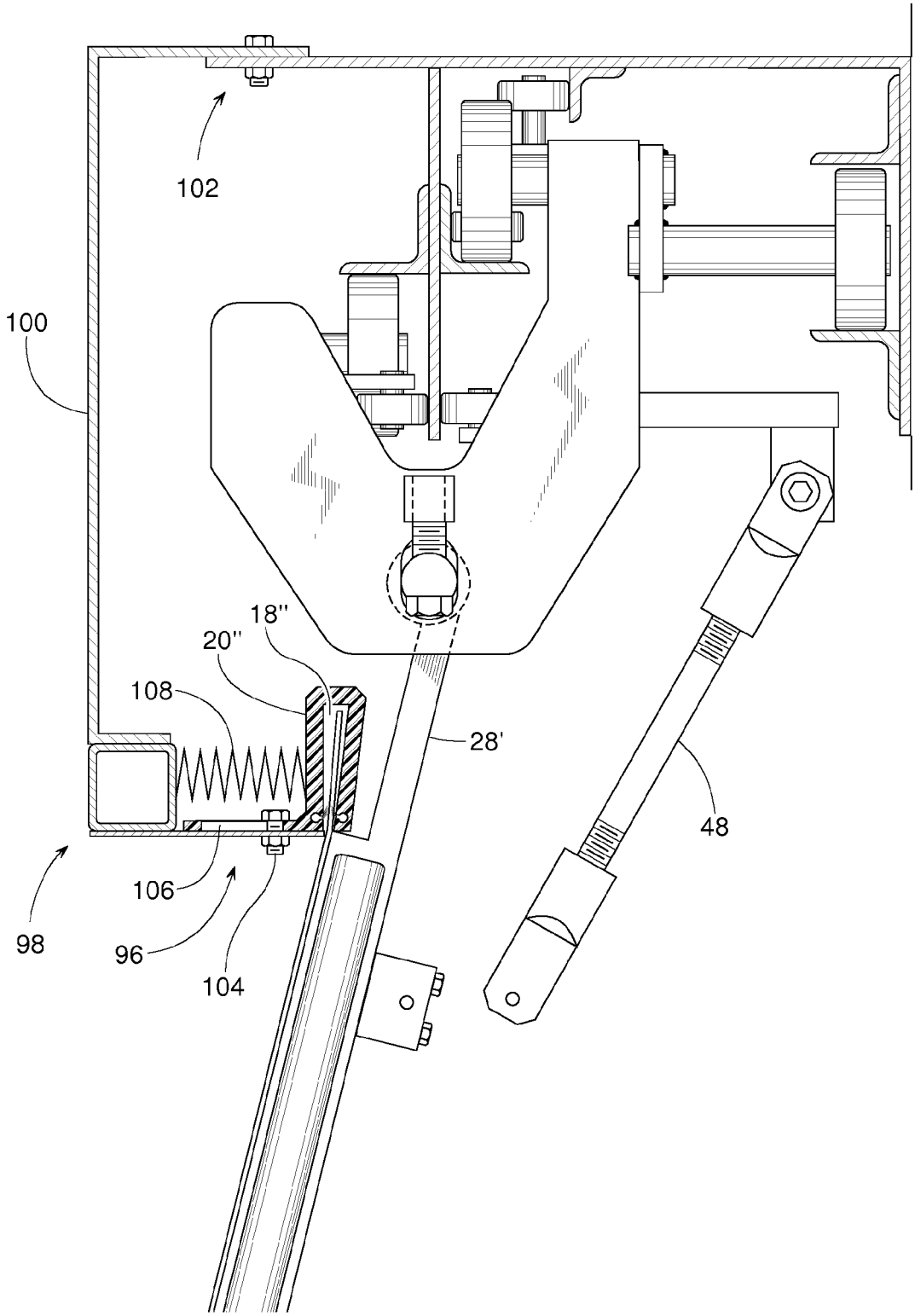
FIG. 15 is a cross-sectional view similar to FIG. 7 but showing the example of FIG. 14.
Figure 16:
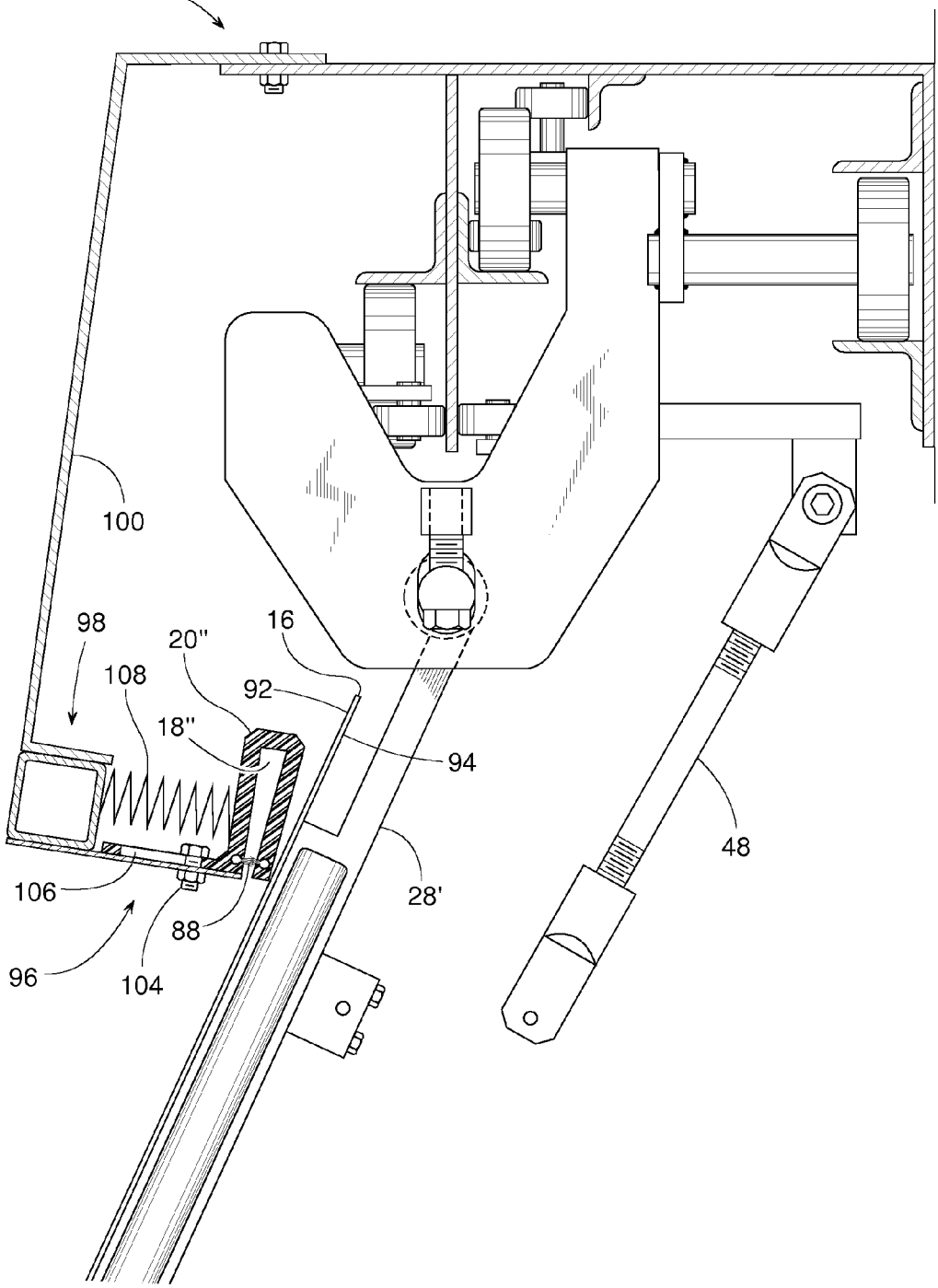
FIG. 16 is a cross-sectional view similar to FIG. 15 but showing the elongate member more tilted.

FIGS. 14-16 show an alternate seal guide 20" with a mounting arrangement that enables seal guide 20" to move out of the way in reaction to being forced over by an elongate member 28'. Depending on the severity of the breakaway, seal guide 20" can move as shown in FIG. 15 or 16.

For a milder breakaway, as shown in FIG. 15, elongate member 28' can push seal guide 20" aside by virtue of a movable connection 96 that couples seal guide 20" to a distal end 98 of a support arm 100. In this example, an anchored end 102 of support arm 100 remains substantially stationary, while a fastener 104 extending through a slot 106 in seal guide 20" or in distal end 98 enables relative movement between seal guide 20" and distal end 98. To urge seal guide 20" back to its normal operating position of FIG. 14, a resilient member 108 can be installed somewhere between distal end 98 and seal guide 20". Resilient member 108 is schematically illustrated to represent anything capable of urging seal guide 20" toward elongate member 28'. Examples of resilient member 108 include, but are not limited to, a compression spring, a piece of spring steel or leaf spring, torsion spring, resiliently compressible foam, etc.

In addition to resilient member 108, or as an alternative to it, support arm 100 itself can be resiliently flexible to accommodate breakaways, as shown in FIG. 16. In this example, the elongate member 28' pushing seal guide 20" even farther over causes support arm 100 to resiliently deflect, which may force the curtain's upper edge 16 out from within a groove 18". After the breakaway, elongate member 28' naturally swings back down and can be reconnected to brace 48. The curtain's upper edge 16 can be reinserted in groove 18" by simply opening and closing the door (e.g., door 10), as shown in FIGS. 10-12.

Although seal guide 20" is shown to include two contacting brush seals 88 that contact both side faces 92 and 94 of the curtain's upper edge 16, seal guide 20" could alternatively include just one brush seal 88 or none.

At least some of the aforementioned examples include one or more features and/or benefits including, but not limited to, the following:

In some examples, a horizontal side-moving door includes an upper seal that includes an integral extension of the door's curtain received within a groove formed in a seal guide disposed adjacent the door.

In some examples, a horizontal side-moving door includes an upper seal guide that can resiliently deflect in reaction to being struck by a relatively stiff, vertically elongate member that serves as a curtain's leading edge.

In some examples, a horizontal side-moving door includes an upper seal with an upper edge that is an integral extension of the door's curtain, wherein a leading end of the upper edge remains within a groove of a seal guide even though other portions of the upper edge might become dislodged out from within the groove.

In some examples, a horizontal side-moving door includes an upper seal that restorably breaks away in reaction to an impact and then automatically feeds back into position by simply opening and closing the door.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A door for a wall defining a doorway with an upper edge and a lateral edge, wherein the door is horizontally movable between an open position and a closed position such that the door obstructs the doorway when the door is in the closed position, and the door exposes the doorway when the door is in the open position, the door comprising:

a track mountable in proximity with the upper edge of the doorway;

a track follower mounted to the track for translation therealong;

an elongate member extending downward from the track follower, the elongate member having a thickness defined by an outer dimension of the elongate member in a direction perpendicular relative to the doorway;

a curtain that includes a leading edge and an upper edge, the leading edge is connected to the elongate member and is generally parallel thereto, the upper edge is generally perpendicular to the leading edge, the curtain having a thickness that is substantially thinner than the thickness of the elongate member, the curtain comprising a rear surface adjacent the doorway and a front surface opposite the rear surface; and a seal guide defining a seal groove extending in a substantially parallel relationship with the track so that the upper edge of the curtain protrudes into the seal groove and slides along the seal groove as the door opens and closes, the seal groove at least partially defined by a front seal portion enabled to seal along a portion of the front surface and a rear seal portion enabled to seal along a portion of the rear surface, at least one of the seal portions is positioned between the upper edge and a portion of the elongate member.

2. The door of claim 1, wherein the door is movable between an operative position and a dislodged position, the elongate member is forcibly movable from being generally vertical when the door is in the operative position to being appreciably inclined when the door is in the dislodged position, and the upper edge of the curtain includes a breakaway portion that is free to escape from within the seal groove as the door moves from the operative position to the dislodged position.

3. The door of claim 2, wherein the elongate member is pivotally coupled to the track follower such that when the door is in the dislodged position, the elongate member can pivot toward the doorway.

4. The door of claim 2, wherein the upper edge of the curtain includes a leading end that protrudes upward from the elongate member, and the leading end remains within the seal groove even when the door moves to the dislodged position.

5. The door of claim 2, wherein the seal guide defines a lead-in opening, wherein after the door moves from the operative position to the dislodged position, the lead-in opening automatically guides the breakaway portion of the curtain's upper edge back into the seal groove as the door moves from the open position to the closed position.

6. The door of claim 1, wherein the seal guide is above an upper end of the elongate member.

7. The door of claim 1, wherein the upper edge is an integral extension of the curtain, whereby the curtain and the upper edge comprises a unitary piece.

8. The door of claim 1, wherein the seal guide is resiliently flexible such that the seal guide can resiliently deflect in response to pivotal movement of the elongate member.

9. The door of claim 1, further comprising:

an arm that includes an anchored end that is substantially stationary and a distal end; and a movable connection coupling the seal guide to the distal end of the arm, whereby the seal guide can move relative to the distal end.

10. The door of claim 9, wherein at least one of the distal end and the seal guide defines a slot at the movable connection.

11. The door of claim 9, further comprising a resilient member extending between the distal end and the seal guide, wherein the resilient member urges the seal guide toward the elongate member.

12. The door of claim 1, further comprising an arm that includes an anchored end that is substantially stationary and a distal end to which the seal guide is mounted, wherein the arm is resiliently flexible to enable the seal guide to move.

13. The door of claim 1, further comprising:

a roller extending vertically and being mountable in proximity with the lateral edge of the doorway, wherein the curtain wraps around the roller such that the roller selectively takes in and pays out the curtain as the door moves between its open position and closed position respectively; and a spring coupled to the roller such that the spring urges the roller to take in the curtain.

14. The door of claim 1, wherein the contacting seal portion is a brush seal.

15. The door of claim 1, wherein the seal groove comprises a brush groove and at least one seal portion comprises a brush.

16. A door for a wall defining a doorway with an upper edge and a lateral edge, wherein the door is horizontally movable between an open position and a closed position such that the door obstructs the doorway when the door is in the closed position, and the door exposes the doorway when the door is in the open position, the door comprising:

a track mountable in proximity with the upper edge of the doorway;

a track follower mounted to the track for translation therealong;

an elongate member extending downward from the track follower to travel therewith to define a path of travel;

a curtain that includes a leading edge and an upper edge, the leading edge is connected to the elongate member and is generally parallel thereto, the upper edge is generally perpendicular to the leading edge, the curtain is more flexible than the elongate member, the curtain to at least partially obstruct the doorway when the door is in the closed position;

a seal guide defining a seal groove and positioned in laterally-spaced relation to the path of travel of the elongate member so that the upper edge of the curtain protrudes into the seal groove and slides along the seal groove as the door opens and closes, a groove into which a portion of the seal guide extends at least partially defined between the upper edge and the elongate member; and two contacting seal member portions at least partially defining the seal groove, wherein the two contacting seal member portions are able to contact a rear surface and a front surface of the upper edge of the curtain.

17. The door of claim 1, wherein the elongate member comprises a first region, and a second region, the first region being positioned adjacent the seal guide and being thinner than the second region.

18. The door of claim 17, further comprising a transition region of the elongate member between the first region and the second region.

19. The door of claim 18, wherein the curtain extends above the transition region.

20. The door of claim 1, wherein the seal guide is mounted from one side of the curtain.

21. The door of claim 1, wherein the seal portions oppose one another and are coupled together by a central portion of the seal guide.

22. The door of claim 1, wherein the seal guide comprises a unitary member.

23. The door of claim 1, wherein the seal guide extends across the upper edge.

24. A door for a wall defining a doorway with an upper edge and a lateral edge, wherein the door is horizontally movable between an open position and a closed position such that the door obstructs the doorway when the door is in the closed position, and the door exposes the doorway when the door is in the open position, the door comprising:

a track mountable in proximity with the upper edge of the doorway;

a track follower mounted to the track for translation therealong;

an elongate member extending downward from the track follower, the elongate member comprising a first portion having a first thickness and a second portion having a second thickness, the second thickness being thicker than the first thickness, the first portion to be positioned between the track follower and the second portion;

a curtain comprising a leading edge and an upper edge, the leading edge being coupled to the elongate member, the upper edge being substantially perpendicular to the leading edge; and a seal guide defining a seal groove positioned to enable the upper edge of the curtain to protrude into the seal groove and slide along the seal groove as the door opens and closes, a portion of the seal guide being positioned in a groove at least partially defined by the upper edge of the curtain and the first portion of the elongate member to enable a surface of the curtain to seal with the seal guide and enable the elongate member to be moveable between the open and closed positions.

* * * * *